US005782671A

United States Patent [19]

Suen et al.

[11] Patent Number: 5,782,671

[45] Date of Patent: Jul. 21, 1998

[54] LIQUID ADJUSTING TYPE MAGNETIC BRASSIERE

[76] Inventors: Yi-Mou Suen, No. 9-2, Lane 35, Tung Te 11th St., Taoyuan City; Kuo-Liang Liou, No. 174, Min Chuan Rd., Chung Li City; Liang-Hung Ho, No. 7, Lane 112, Wen Chang St., Pa Te City, all of Taiwan

[21] Appl. No.: 850,683

[22] Filed: May 2, 1997

[51] Int. Cl.[6] ..... A41C 3/00; A41C 3/12

[52] U.S. Cl. ..... 450/38; 450/57; 2/267; 2/273

[58] Field of Search ..... 2/267, 268, 273, 2/275, 73; 450/30, 31, 32, 38, 39, 53, 54, 55, 56, 57, 92, 93; 623/7, 8

[56] References Cited

U.S. PATENT DOCUMENTS

| | | | |
|---|---|---|---|
| 2,636,182 | 4/1953 | Freedman | 623/7 |
| 2,698,436 | 1/1955 | Bernhardt | 623/7 |
| 2,752,602 | 7/1956 | Wilhelm | 623/7 |
| 3,190,292 | 6/1965 | Barnes | 450/55 |
| 3,494,365 | 2/1970 | Beals | 450/7 |
| 3,576,037 | 4/1971 | Klein | 623/7 |
| 3,619,819 | 11/1971 | Manu | 623/7 |
| 3,896,506 | 7/1975 | Hankin et al. | 623/7 |
| 4,023,575 | 5/1977 | Nixon | 623/7 |
| 4,125,117 | 11/1978 | Lee | 450/57 |
| 5,133,752 | 7/1992 | Mandelkern | 623/7 |

*Primary Examiner*—Jeanette E. Chapman
*Attorney, Agent, or Firm*—Morton J. Rosenberg; David I. Klein; Jun Y. Lee

[57] ABSTRACT

A liquid adjusting type magnetic brassiere including an oval sac in each cup of the brassiere, the sac having a curved chamber at a lower half portion for containing a liquid, and a plurality of air vents at an upper half portion. The liquid in the chambers provides a natural and elastic support for the breasts. A plurality of small magnets are radially arranged on the surface of the sac to generate lines of magnetic force which may promote blood circulation and metabolism in the breasts.

2 Claims, 8 Drawing Sheets

LIQUID ADJUSTING TYPE MAGNETIC BRASSIERE

BACKGROUND OF THE INVENTION +ps (a)

Field of the Invention:

The present invention relates generally to an improved brassiere structure, and more particularly to a brassiere structure which utilizes the complementary effects of lines of magnetic force and movement of liquid to promote breast circulation and metabolism.

(b) Description of the Prior Art:

Females generally care about the size of their busts, and those who wish to have full and firm breasts may spend huge sums on plastic surgery, expensive medication, fitness centers, etc. But these methods are not without risks, and the consequences may be irreparable.

In view of the above, adjusting brassieres which utilize physical instead of chemical stimulation to make the breasts look firmer and more fuller have been developed. Compared to plastic surgery and expensive medication, adjusting brassieres are more economical and therefore more popular. More importantly, there are no risks or side effects. There are various types of adjusting brassieres having different functions and meeting different requirements available in the marketplace. FIGS. 1 and 2 show a brassiere with air sacs in the cups, as disclosed in R.O.C. Publication No. 274697. This structure essentially comprises an air sac 11 disposed in each cup of the brassiere. The lateral end of the air sac 11 is provided with an inflation nozzle 12, and the air sac 11 is filled with soft foamed material 13. As the network-like elastic structure of the foamed material 13 may hold the air, the air sac 11 elasticity and firmness.

In R.O.C. Publication No. 214038, which discloses a massaging brassiere, the brassiere essentially comprises a water-impermeable container in each cup, the container being filled with two liquids which are not soluble in each other and have different weight ratios. By utilizing the movement of the two liquids of different weight ratios inside the respective containers, a natural massaging effect on the breasts may be achieved.

Existing adjusting brassieres have their own features and functions. However, there are drawbacks with them too. For instance, although elasticity is achieved by filling the air sacs in the cups with air, the cups must be air-tight in order to prevent leakage of air. If the brassiere is worn for a prolonged period, the wearer's breasts may easily perspire due to poor air ventilation. Blood circulation is also hampered.

Furthermore, for brassieres with containers holding liquids, if the containers are not properly designed, the liquids inside will flow in all directions with the movement of the wearer when she is running or performing other strenuous exercises. Sometimes, there may even be sounds of the liquids rushing against the walls of the containers, which is unnatural and embarrassing to the wearer.

In addition, conventional adjusting brassieres have not employed the action of the line of magnetic force to promote circulation of blood and metabolism in the breasts to achieve firmer and fuller breasts. According to scientists, the growth and health of people are very much related to the earth's magnetic field. But buildings, electric cables and wires, etc., have blocked the earth's magnetic field so that people have less magnetic force, which affects blood circulation and metabolism. In order to increase the magnetic force in people, in addition to a balanced diet with mineral supplements to achieve balance in electrolysis, magnetic exercising apparatuses may also be used. However, these apparatuses are generally bulky and not portable. Brassieres are worn by females almost 24 hours of the day, if they are provided with magnetic waves, it is believed that they will enhance blood circulation and metabolism in the breasts to achieve firmer and fuller busts.

SUMMARY OF THE INVENTION

According to a first aspect of the present invention, the adjusting magnetic brassiere essentially comprises an oval sac provided in each cup of the brassiere depending on the shape of the cup, the surface of the sac being radially provided with a plurality of small magnets, the lines of magnetic force generated thereby and the undulation of a liquid contained in a chamber at the lower portion of the sac being utilized to promote circulation of blood in the breasts and metabolism.

According to a second aspect of the present invention, the oval sacs are each provided with a plurality of air vents in an upper portion thereof so that there is good air ventilation.

According to a third aspect of the present invention, the oval sac is provided with a partition for defining a chamber filled with a liquid at a suitable position so that the liquids inside the chamber will not flow in all directions or generate embarrassing sounds when the wearer performs violent movements.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
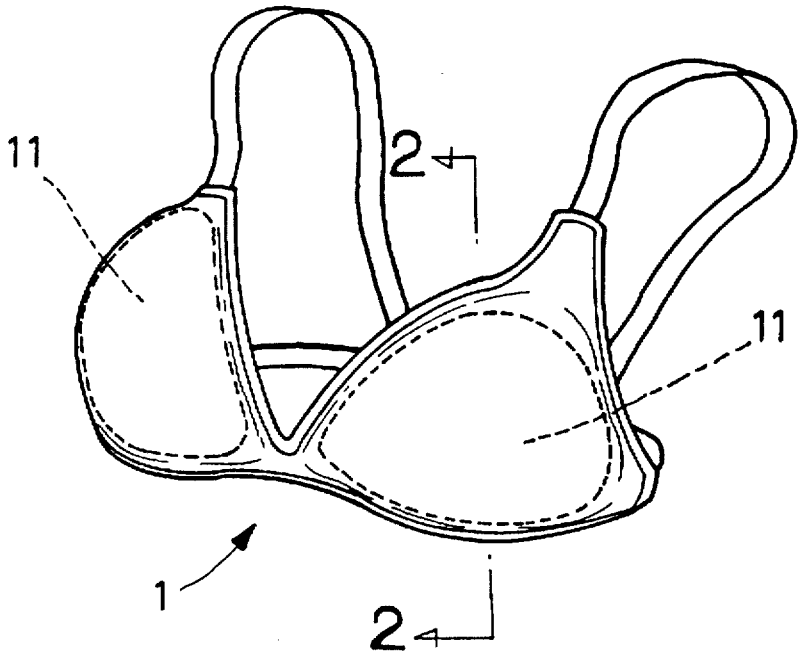
PRIOR ART FIG. 1
FIG. 1 is an elevational view of a conventional adjusting brassiere.
Figure 2:
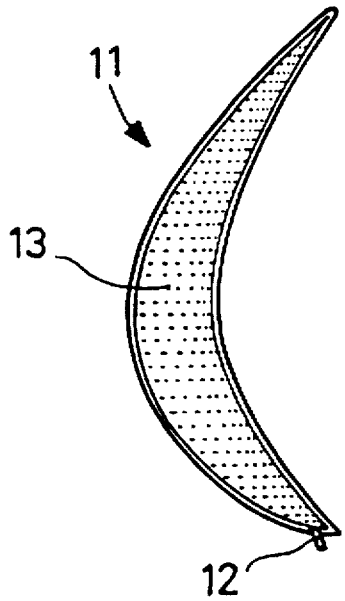
PRIOR ART FIG. 2
FIG. 2 is a sectional view of an air sac of the conventional adjusting brassiere.
Figure 3:
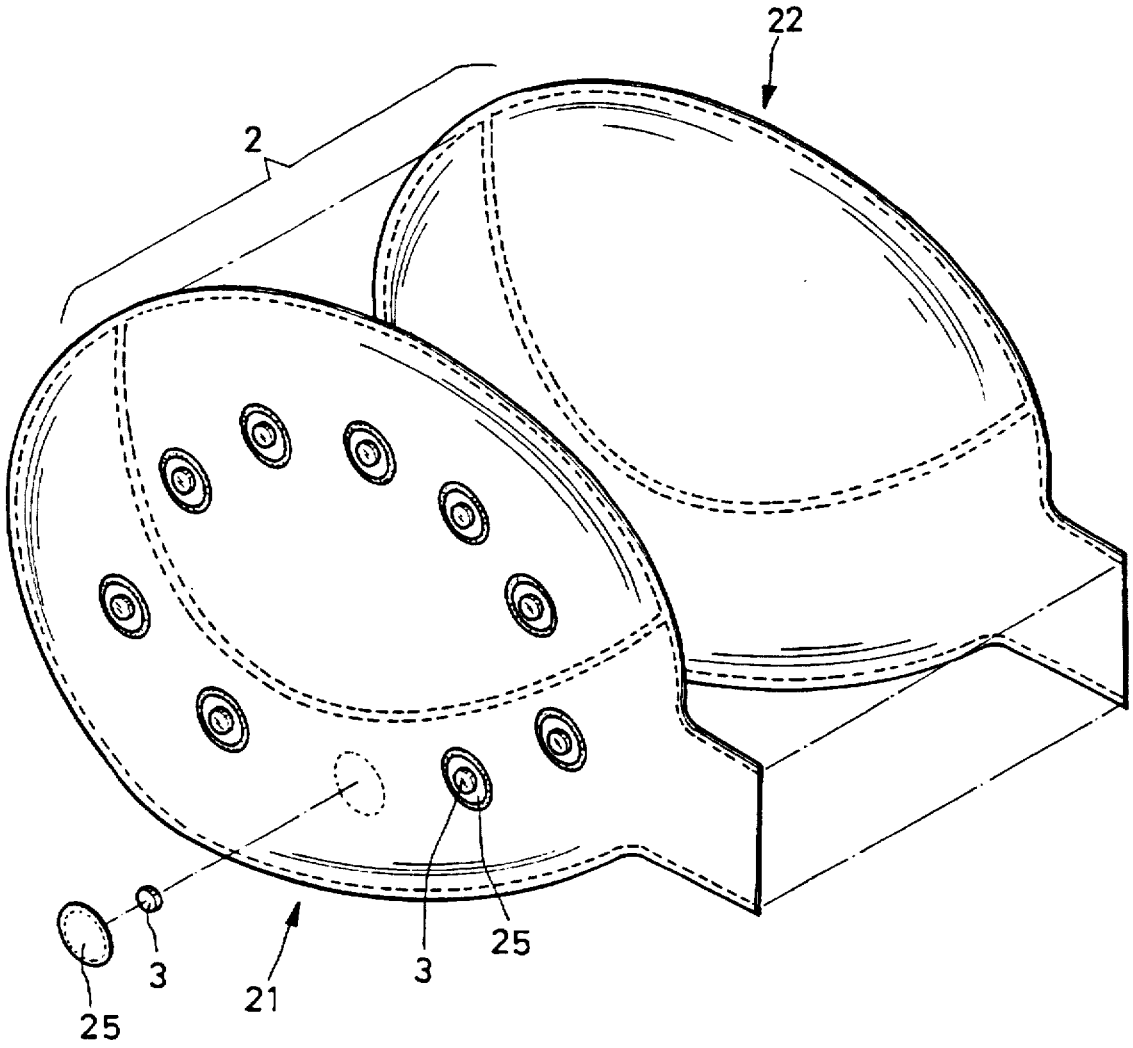
FIG. 3 is a schematic exploded view of the sac structure of the present invention.
Figure 4:
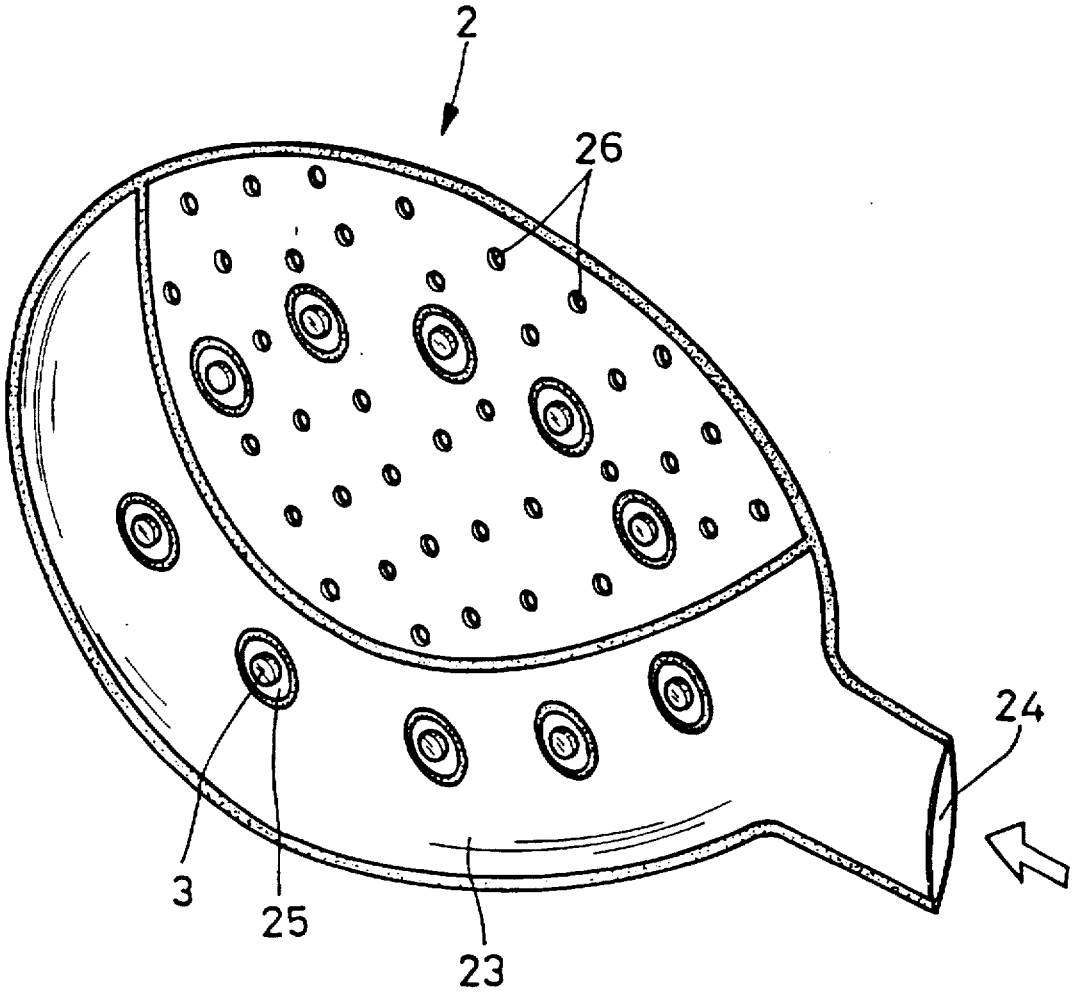
FIG. 4 is a schematic view of the sac structure of the present invention.

With reference to FIGS. 3 and 4, the liquid adjusting type magnetic brassiere according to the present invention essentially comprises two oval sacs 2, a required number of small magnets 3. One oval sac 2 is placed in each of the cups of the brassiere, and each oval sac 2 comprises two water impermeable sheets 21, 22 of a soft and supple plastic material, the sides of which are fused by high frequency waves. During fusion using high frequency waves, the lower portion of the sac 2 is configured into a curved chamber 23 with a filling hole 24 at a lateral side.

Each small magnet 3 is fused to one small plastic sheet 25, and the small magnets 3 along with their small plastic sheets 25 are arranged radially on the surface of the soft plastic sheet 21.

Figure 5:
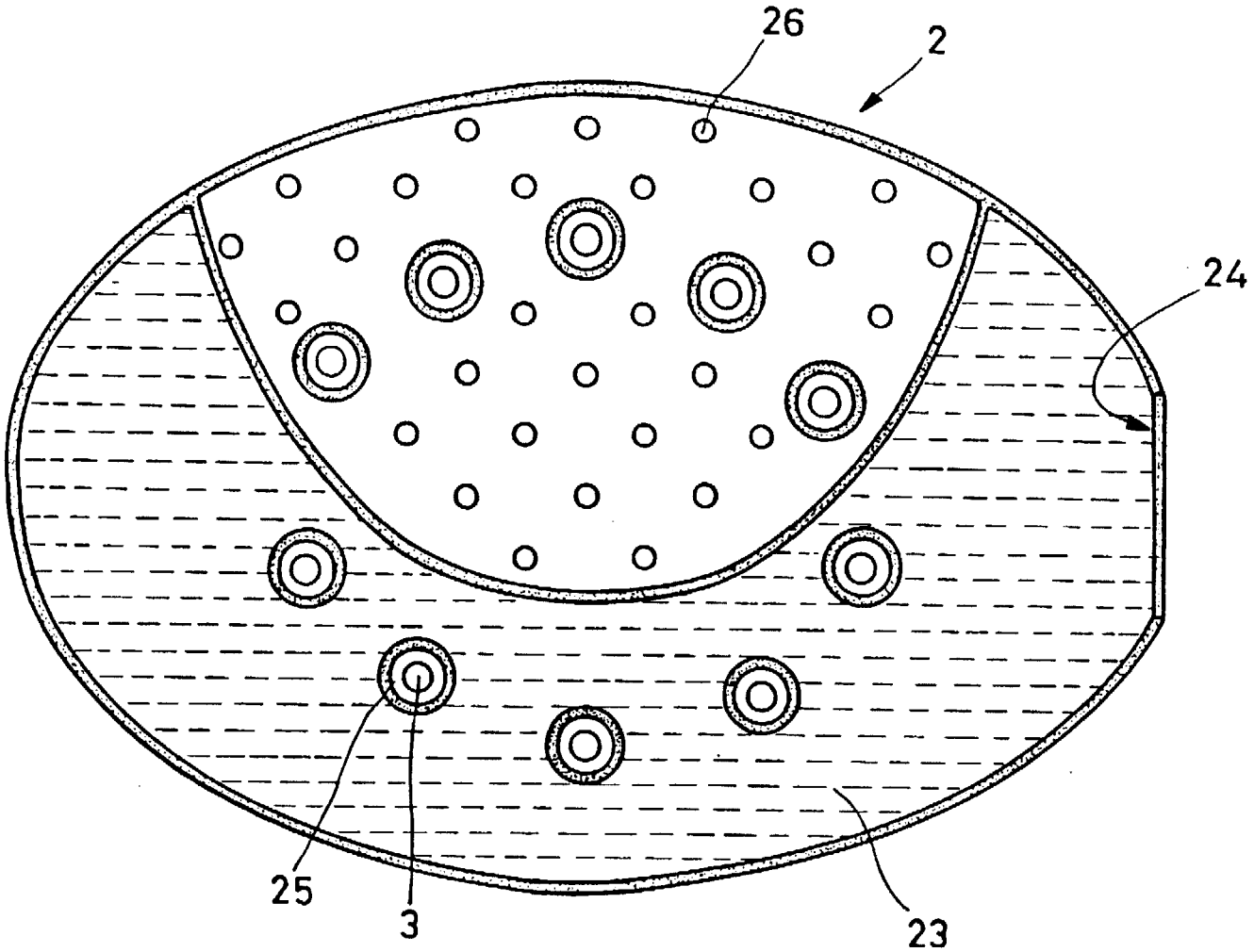
FIG. 5 is a schematic view after a chamber of the sac structure is filled with a liquid.

Referring to FIG. 4, after the sac 2 is formed using high frequency waves, a plurality of air vents 26 are punched at the upper portion thereof. Then a required amount of a liquid is filled into the chamber 23 through the filling hole 24. The filling hole 24 is then sealed using high frequency waves, as shown in FIG. 5, so that the chamber 23 forms a supple and natural support, while the upper portion of the sac 2 is thinner and permits air ventilation.

Figure 6:
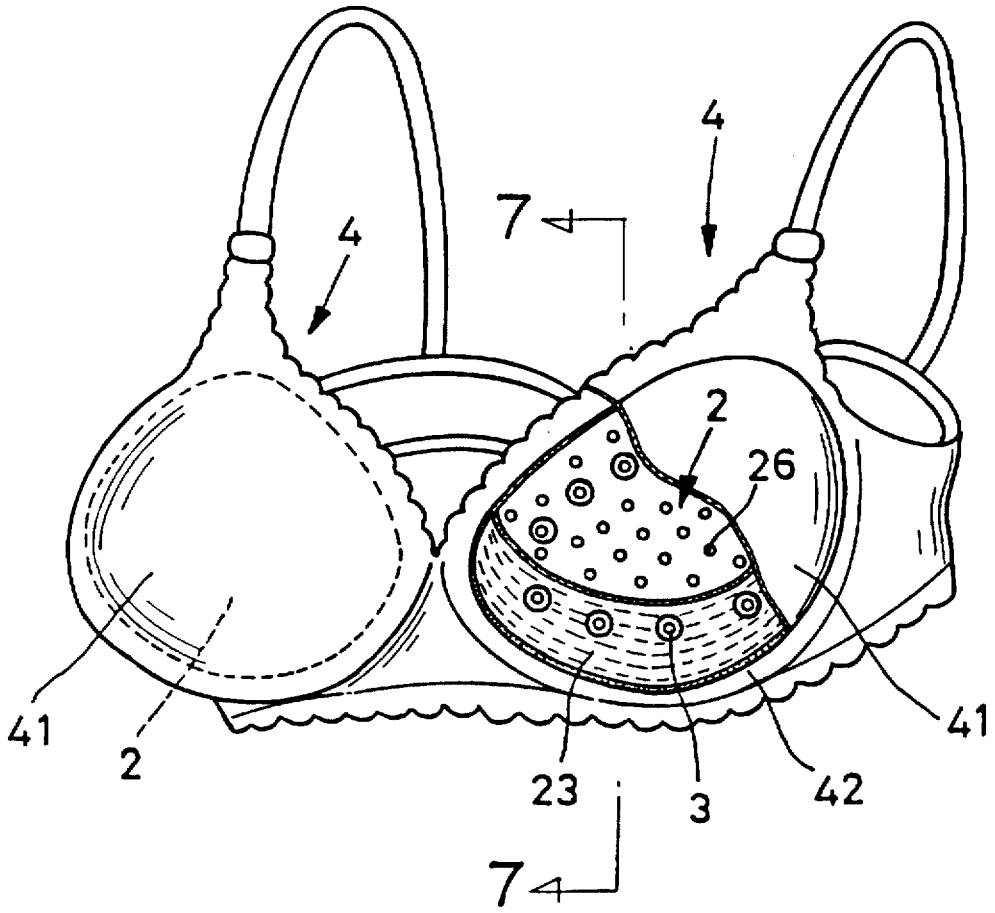
FIG. 6 is an elevational view of a preferred embodiment of the present invention.

Referring now to FIG. 6, each oval sac 2 as described above is disposed between an outer fabric 41 and an inner cotton panel 42 of each cup 4 so that it is coupled with the cup 4 as a whole.

Figure 7:
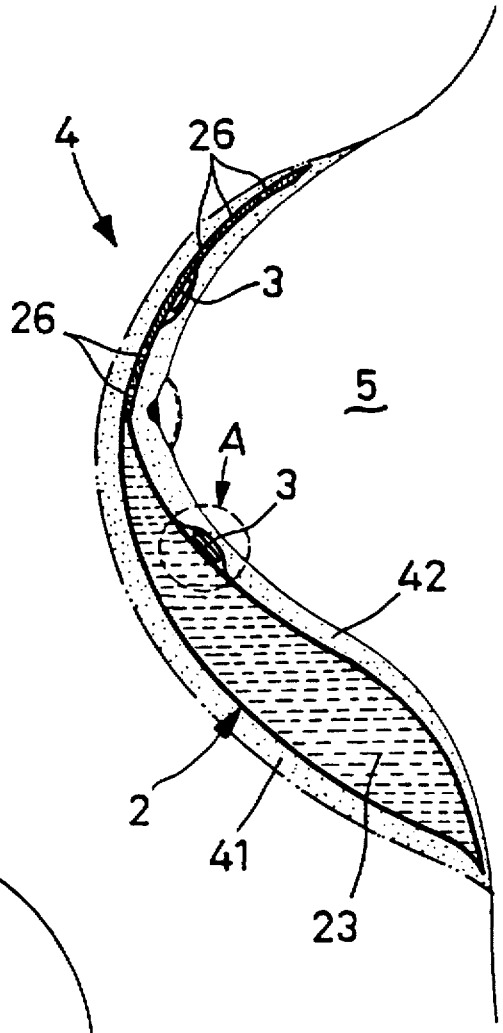
FIG. 7 is a schematic sectional view of FIG. 6 taken along line 7—7, showing use of the sac structure in a brassiere.
Figure 7A:
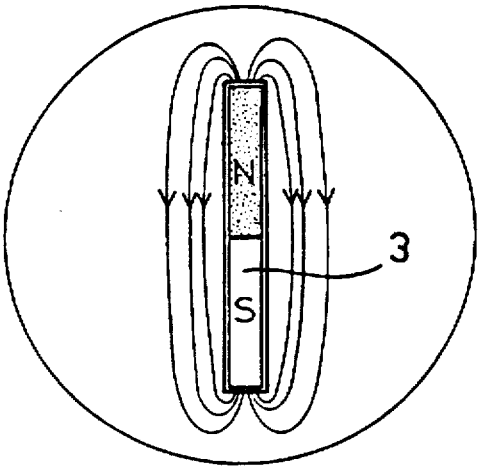
FIG. 7A is a schematic view illustrating the action of the line of magnetic force of the small magnets.

With reference to FIGS. 7 and 7A, since the sac 2 is configured to match each cup 4, and there is an inner cotton panel 42 between the sac 2 and the wearer's breasts, the adjusting brassiere of the invention is as comfortable to wear as ordinary brassiere. The lines of magnetic force generated between the magnetic North (N) and the magnetic South (S) by the small magnets 3 distributed at the peripheral areas of the wear's breasts 5 are diffused by the liquid contained in the respective chambers 23 located at the lower portion of the sacs 2 in the cups 4 to achieve magnetic waves effects, which may promote blood circulation and metabolism in the breasts 5. Furthermore, the air vents 26 at the upper half portion of the sacs 2 provide good ventilation. Besides, as each sac 2 is held between the inner cotton panel 42 and the outer fabric 41 of each cup 4, it will not slip out or displace. The liquid in the chamber 23 in each sac 2 provides a natural elastic support and may match the curve of the breast 5. A major difference between the adjusting brassiere of the invention and existing adjusting brassiere is that a liquid is provided in the chambers 23 of the cups 4 to naturally support the breasts 5, not using means such as wires to press the breasts 5 to a desirable shape. Therefore, the wearer will not feel uncomfortable or pressured. Furthermore, from the outside, it can hardly be perceivable that the breasts 5 are actually supported by the liquid in the cups.

Figure 8:
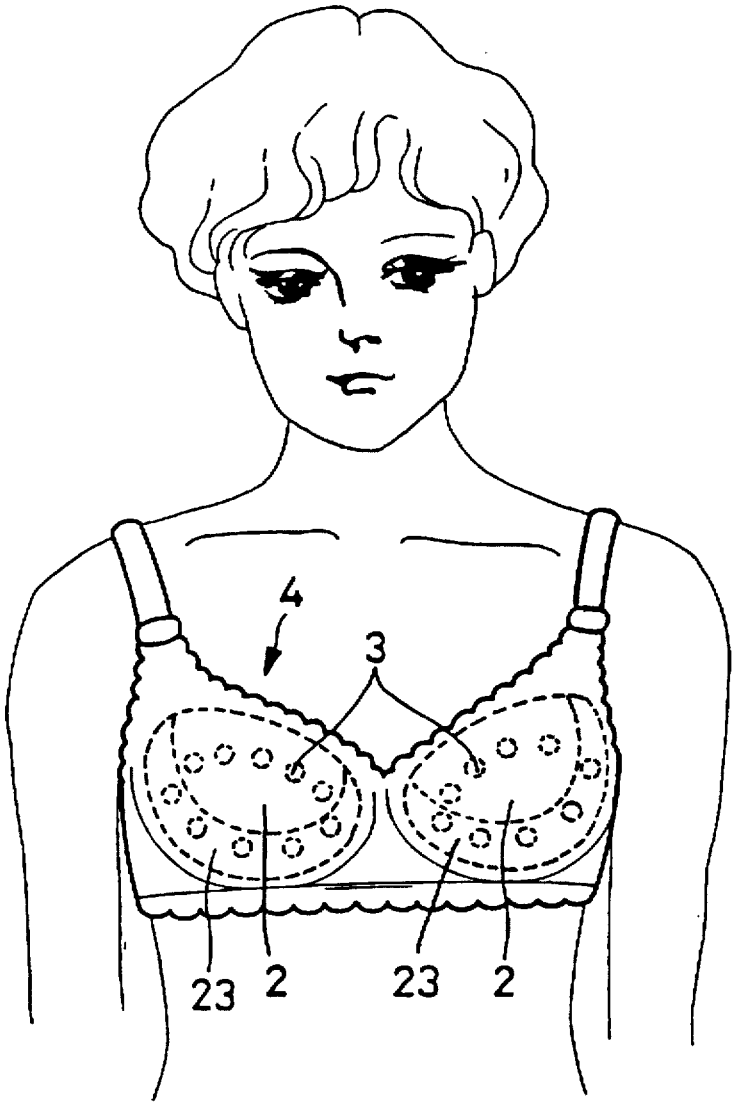
FIG. 8 is a schematic view illustrating the present invention in use.

FIG. 8 shows the present invention in use. An important feature of the adjusting brassiere of the invention is that it can be wore easily like ordinary brassiere, without the problem in existing adjusting brassiere which must be tied firmly around the chests and press the breasts.

Figure 9:
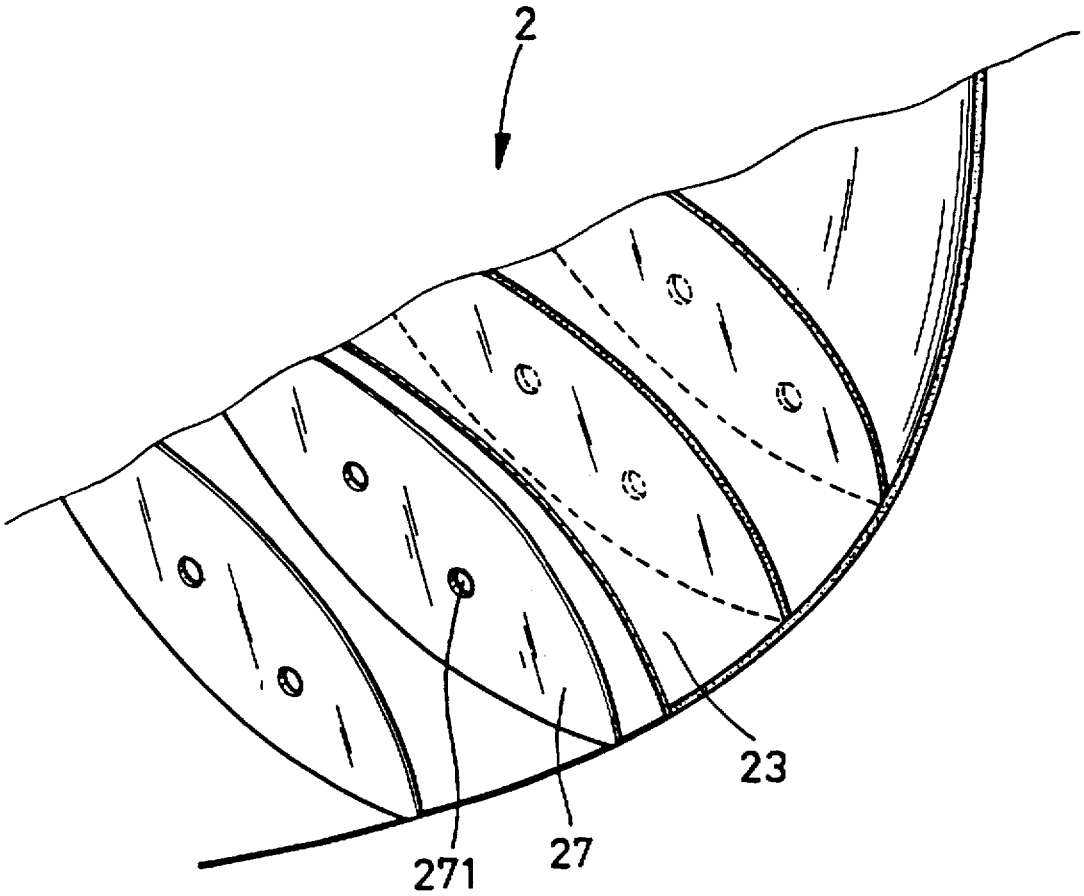
FIG. 9 shows another preferred embodiment of the present invention.

FIG. 9 shows another preferred embodiment of the sac 2, a plurality of longitudinal partitions 27 using the same soft supple plastic material as the sac 2 are formed in chamber 23. Each partition 27 is provided with a plurality of through holes 271. Therefore, liquid in the chamber 23 may flow via the through holes 271 and distribute evenly all over the chamber 23. When the wearer runs or performs strenuous exercises, the liquid in the chamber 23 in each sac 2 will not flow quickly to one side and stay there to produce rushing sounds or obvious shaking which will embarrass the user. Thus, the wearer will feel very natural and comfortable.

Below is a comparison table showing the advantages of the present invention and the disadvantages with known bust increasing methods:

| Types | Advantages/Disadvantages |
|---|---|
| Injection and medication | Costly; side effects |
| Plastic surgery | Costly; risky; various side effects |
| Ordinary adjusting bra | Undue pressure on the breasts; unnatural and inconvenient to wear |
| Ordinary adjusting bra with liquid sacs | Produce unnatural shaking and embarrassing sounds |
| Ordinary adjusting bra with air sacs | Poor air ventilation; unnatural look |
| Liquid adjusting type magnetic bra of the present invention | 1. Easy to wear, natural, cheap<br>2. No side effects or risks<br>3. Physical effects attainable by use of magnetic force in conjunction with movement of liquid |

Although the present invention has been illustrated and described with reference to the preferred embodiment thereof, it should be understood that it is in no way limited to the details of such embodiment but is capable of numerous modifications within the scope of the appended claims.

What is claimed is:

1. A liquid adjusting type magnetic brassiere, comprising a sac shaped to match a cup of the brassiere for holding a liquid and disposed in each cup of the brassiere between an inner cotton panel and an outer fabric of the cup, wherein said sac comprises two sheets of water impermeable soft, supple plastic material being fused by use of high frequency waves into an oval sac with a curved chamber formed at a lower half portion of said sac, and a filling hole at a lateral side of said chamber for filling of a suitable amount of liquid into said chamber before being sealed by use of high frequency waves; one of said sheets having a plurality of small plastic sheets of the same soft, supple plastic material fused thereonto in a radial arrangement, each of said small plastic sheets having a small magnet attached thereto; an upper half portion of said sac being thinner and punched with a plurality of air vents.

2. A liquid adjusting type magnetic brassiere as claimed in claim 1, wherein said chamber of said sac is provided with a plurality of partitions therein, each of said partitions having a plurality of through holes.

* * * * *